US005594421A

United States Patent [19]

Thuillard

[11] Patent Number: 5,594,421

[45] Date of Patent: Jan. 14, 1997

[54] METHOD AND DETECTOR FOR DETECTING A FLAME

[75] Inventor: Marc P. Thuillard, Männedorf, Switzerland

[73] Assignee: Cerberus AG, Mannedorf, Switzerland

[21] Appl. No.: 574,773

[22] Filed: Dec. 19, 1995

[30] Foreign Application Priority Data

Dec. 19, 1994 [EP] European Pat. Off. ..... 94120083

[51] Int. Cl.[6] ..... G08B 17/12

[52] U.S. Cl. ..... 340/578; 340/577; 250/554

[58] Field of Search ..... 340/577, 578, 340/600, 584; 250/554, 339.01

[56] References Cited

U.S. PATENT DOCUMENTS

| | | | |
|---|---|---|---|
| 3,739,365 | 6/1973 | Müller | 340/578 |
| 4,206,454 | 6/1980 | Schapisa | 340/578 |
| 4,280,058 | 7/1981 | Tar | 250/554 |
| 4,988,884 | 1/1991 | Dunbar | 340/578 |
| 5,434,560 | 7/1995 | King | 340/578 |

FOREIGN PATENT DOCUMENTS 0646901 4/1995 European Pat. Off. .

*Primary Examiner*—Jeffery Hofsass
*Assistant Examiner*—Anh V. La
*Attorney, Agent, or Firm*—Brumbaugh, Graves, Donohue & Raymond

[57] ABSTRACT

A flame is detected by signal analysis for intensity variations in radiation received by a sensor. A low-frequency spectrum of the signal is analyzed for mid- and cut-off frequencies, and the signal is classified as periodic or non-periodic. Periodic signals with a mid-frequency ($\omega_{mp}$) above a first frequency value ($G_1$), and non-periodic signals with a cut-off frequency ($\omega_{gc}$) above a second frequency value ($G_2$) are classified as interfering signals. The first frequency value is determined by the flicker frequency of a stationary flame having a magnitude corresponding to a flame of minimum magnitude to be detected. The second frequency value is selected greater than the first frequency value ($G_1$).

9 Claims, 1 Drawing Sheet

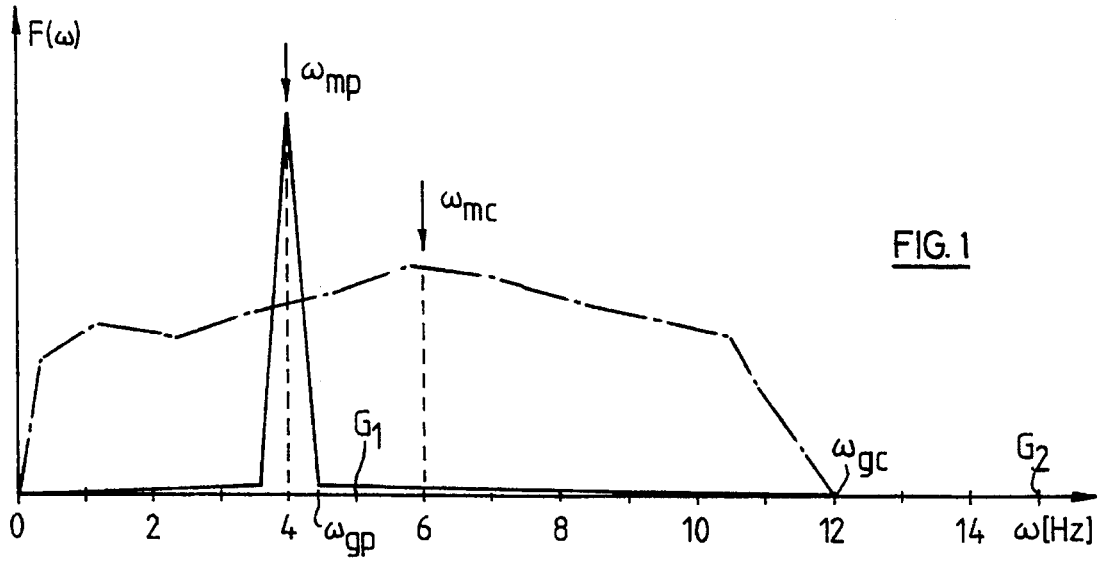
FIG. 1
FIG. 2
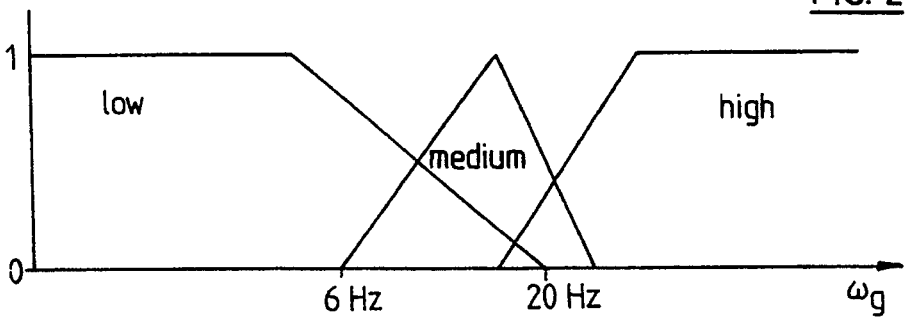
FIG. 3
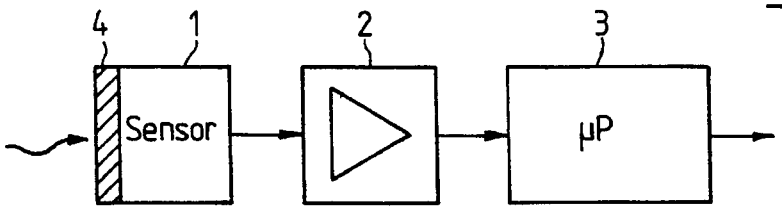

METHOD AND DETECTOR FOR DETECTING A FLAME

BACKGROUND OF THE INVENTION

The present invention relates to flame detection and, more specifically in flame detection, to techniques involving analysis of radiation intensity variations for distinguishing flame radiation from interfering radiation.

In flame-detection techniques of interest, a radiation sensor receives radiation whose flicker characteristics in a very low frequency range are used to distinguish between interfering radiation and radiation originating from a flame. Simple means for delimiting the frequency range or band include radiation-input filters and frequency-selective sensor-signal amplifiers, in both cases for realizing a predetermined passband, e.g., from 5 to 25 Hz. But even if the passband is optimally chosen for the detection of flame flicker, malfunctioning and false indications are relatively frequent, as it is quite common for unanticipated intensity variations of ambient radiation to lie in the passband. Such intensity variations can be caused, e.g., by shading or reflections by vibrating or slowly moving objects, by reflections of sunlight from water surfaces, or by flickering or unsteady light sources.

U.S. Pat. No. 3,739,365 discloses a method of the aforementioned type in which the susceptibility to interfering light is reduced by use of two types of sensors with different spectral sensitivities, and forming of the difference between the two sensor output signals in a limited low-frequency range.

In practice, it has been found that the susceptibility to extraneous radiation sources, and thus the probability of false alarms remain relatively high because interfering radiation may well appear in the critical frequency range. For this reason, the critical frequency range in state-of-the-art flame detectors consists of just a few narrow frequency bands. For example, U.S. Pat. No. 4,280,058 discloses evaluation, for alarm, of emissions in a wavelength range of approximately 4.4 μm, i.e., in a range which is characteristic of carbon-dioxide combustion. But still, this does not prevent interfering radiation in this wavelength range from triggering a false alarm.

Sought are reliability in flame detection, elimination of interfering radiation, minimization of false alarms, and broad applicability.

SUMMARY OF THE INVENTION

Radiation is analyzed for mid- and cut-off frequencies and for periodicity. Periodic signals with a mid-frequency greater than a first frequency value, and non-periodic signals with a cut-off frequency greater than a second frequency value are classified as interference signals. The first frequency value corresponds to the flicker frequency of a stationary flame with minimum size or magnitude to be detected. The second frequency value is chosen greater than the first frequency value.

A preferred flame detector has at least one sensor for flame radiation to be detected, and evaluating electronics coupled to the sensor for analyzing detected radiation for its mid- and cut-off frequencies, and for distinguishing flame radiation on the basis of these frequencies.

In a particularly preferred embodiment, the electronics includes a microprocessor with a fuzzy-logic controller.

BRIEF DESCRIPTION OF THE DRAWING

Preferred embodiments are described hereinafter with reference to the drawings.

FIG. 1 shows graphs of flicker spectra of periodic and non-periodic flames, respectively.

FIG. 2 shows graphs of fuzzy-membership functions for the spectra of FIG. 1.

FIG. 3 is a block diagram of a flame detector in accordance with a preferred embodiment of the invention.

DETAILED DESCRIPTION OF PREFERRED EMBODIMENTS

The following preliminary considerations may be considered for motivation of the preferred technique.

A flame can have two states: a stationary state in which the flame burns in a stable, undisturbed manner (so-called periodic flame) and a quasi-stationary state in which the flame burns in an unstable manner (so-called non-periodic flame). A periodic flame has a frequency or Fourier spectrum with a pronounced low-frequency peak. A non-periodic flame has a broad-band spectrum with a maximum or cut-off frequency.

Similar considerations apply to interfering radiation. Some interfering sources such as welding apparatus or rays of sunlight through a leaf cover have a broad Fourier spectrum. Others, such as a lamp being lit or hot air moved by a fan have a narrow frequency peak.

As experimentally verified, the frequency of a periodic flame is approximately one-third to one-half of the cut-off frequency of a non-periodic flame of the same magnitude. This fact can be used in distinguishing flame-radiation signals from interfering-radiation signals, for periodic and non-periodic signals.

It is known that, in a first approximation, the flicker frequency of a stationary flame depends only on the flame diameter. This applies to a wide variety of fuels such as liquid hydrocarbons and PMMA, for example, as experimentally confirmed for flame diameters from 0.1 m to 100 m, and also to the flicker frequency of a stationary helium plume. The Fourier spectrum of a flame either has a pronounced narrow peak, or else is a broad-band "washed out" spectrum without a peak. These two types of spectra are shown in FIG. 1, where frequency $\omega$ is on the abscissa and amplitude $F(\omega)$ on the ordinate.

One spectrum, drawn in FIG. 1 as a solid line, has a pronounced peak with mid-frequency $\omega_{mp}$ and upper cut-off frequency $\omega_{gp}$, where $$\omega_{gp} \approx \omega_{mp} \qquad \text{(Formula 1)}$$

A spectrum of this type is characteristic of a so-called periodic flame burning in an undisturbed and stable manner, the mid frequency $\omega_{mp}$ lying below 5 Hz for a flame diameter of 10 cm and decreasing slowly with increasing diameter.

The other spectrum, drawn as a chain-dotted line, with mid-frequency $\omega_{mc}$ and cut-off frequency $\omega_{gc}$ is broad-band. A spectrum of this type is characteristic of a flame in an unstable, non-stationary, so-called non-periodic state. As shown, the cut-off frequency $\omega_{gc}$ of the broad-band spectrum is greater than the mid-frequency $\omega_{mp}$ of the periodic flame:

$$\omega_{gc} > \omega_{mp} \qquad \text{(Formula 2)}$$

Based on investigations into the Fourier spectra of flames, the following inequality holds:

$$\omega_{gc}<3\omega_{mp} \quad \text{(Formula 3)}$$

These relationships may be understood as follows: if a flame burns without interference in a stationary state, the convection cells which form the flame are stationary in number and size, and the flame has a constant flicker frequency $\omega_1$, with $\omega_1 \approx \omega_{mp} \approx \omega_{gp}$. However, if the flame is exposed to external influences such as wind, convection cells can split or aggregate, with both processes being delimited. In view of Formulae 1 to 3, the (broad-band) spectrum of a non-periodic flame most likely contains no frequencies greater than three times the flicker frequency $\omega_0$ of a stationary flame of equal magnitude.

A specific flicker frequency $\omega_0$ can be calculated as follows:

$$\omega_0 \approx K\sqrt{g/D} \quad \text{(Formula 4)}$$

In Formula 4, K denotes a known factor, g denotes gravity, and D denotes the diameter of a dish-shaped container in which a liquid burns with a flame of the respective magnitude. The terms K and g can be combined, yielding the following equation for $\omega_0$:

$$\omega_0 \approx 1.5/\sqrt{D} \quad \text{(Formula 5)}$$

For a dish diameter of 0.1 m, Formula 5 yields a value of 4.7 Hz for $\omega_0$. Lesser values are obtained when measuring the flicker frequency.

For detector calibration, first the minimum diameter is determined of a flame, fire or conflagration to be detected. If this is 10 cm, for example, the frequency $\omega_{mp} \approx \omega_{gp}$ of a periodic flame is less than 5 Hz, and the cut-off frequency $\omega_{gc}$ of a non-periodic flame of equal magnitude assuredly is less than 15 Hz. Two threshold frequency values $G_1$ and $G_2$ are then determined for periodic and non-periodic interfering signals, respectively: the threshold value $G_1$ for periodic interfering signals preferably according to Formula 2 with $G_1>\omega_{mp}$, i.e. at about 5 Hz, and the threshold value $G_2$ for non-periodic interfering signals according to Formula 3 with $G_2>3\omega_{mp}$, e.g. at about 15 Hz.

In detector operation, the detector sensor signal is analyzed for periodicity. A periodic signal is classified as an interfering signal if its mid-frequency exceeds the value $G_1$. A non-periodic signal is classified as an interfering signal if its cut-off frequency exceeds the value $G_2$. For a determination of periodicity/non-periodicity of the signal, the difference of cut-off frequency minus mid-frequency can be formed and divided by the cut-off frequency. If the resulting quotient is on the order of ones, the signal is non-periodic. If the quotient is significantly less than one, the signal is periodic.

The sensor signals are characterized by three values as follows:

square signal $X_i^2=\Sigma x_k^2$, k: 1 . . . i being the sum of squares of i detector signal values $x_k$, where, preferably, i is at least 3 and not greater than 100, with i=10 being typical;

mid-frequency $\omega_m$ of the Fourier spectrum ($\omega_m=\omega_{mp}$); and cut-off frequency $\omega_g$ of the Fourier spectrum ($\omega_g=\omega_{gc}$).

A preferred first method of signal evaluation can be carried out with reference to the following general criteria:

For further consideration, the square signal must exceed a predetermined minimum value.

Signal periodicity/non-periodicity is determined.

Periodic signals are suppressed if their mid-frequency $\omega_m$ exceeds $G_1$, where $G_1>\omega_{mp}$.

Non-periodic signals are suppressed if their cut-off frequency $\omega_g$ exceeds $G_2$, where $G_2>3\omega_{mp}$.

With these criteria, interfering signals can be largely suppressed, and false alarms are minimized.

The reliability of protection against false alarms can be enhanced further if fuzzy-logic is used in signal analysis. An introduction to fuzzy-logic is given, e.g., in the book by H.-J. Zimmermann, *Fuzzy Set Theory and its Applications*, Kluver Academic Publishers, 1991 and in European Patent Application 94113876.0 owned by the assignee of the present application. Key concepts of fuzzy-logic include fuzzy or imprecise sets, with imprecise membership of elements being defined by a membership function. The membership function is not an either-or, 0-or-1 function as in ordinary logic, but may also assume values in between.

Replacement of precise quantities with imprecise quantities is called fuzzifying. Each input variable, i.e. one of the above-mentioned signals, has at least one membership function as represented by a matrix. The x-coordinate of this function corresponds to that of a respective signal, and the y-coordinate corresponds to the truth value or the degree of certainty of a respective membership or statement. The y-coordinate can assume any value from 0 to 1.

FIG. 2 illustrates a membership function of the cut-off frequency $\omega_g$ for a flame diameter of 10 cm, based on calculated cut-off values. Similar membership functions are defined for the square signal $X_i^2$ and the mid-frequency $\omega_m$ of the Fourier spectrum, and fuzzy-rules are used in analyzing these three values. For example, the fuzzy-rules may be as follows:

If [$(\omega_g-\omega_m)/\omega_g$=high and $\omega_g$=low or medium, and $X_i^2$= high], then flame.

If [$(\omega_g-\omega_m)/\omega_g$=high and $\omega_g$=high, and $X_i^2$=high], then broad-band interfering radiation source.

If $X_i^2$=low, then normal state.

If [$(\omega_g-\omega_m)/\omega_g$=low and $\omega_g$=low, and $X_i^2$=high], then flame.

If [$(\omega_g-\omega_m)/\omega_g$=low and $\omega_g$=medium or high, and $X_i^2$= high], then periodic interfering radiation source.

The frequencies $\omega_m$ and $\omega_g$ can be determined by fast Fourier transform (FFT) or by other methods which may be simpler and/or faster, e.g., zero crossing (i.e., determination of transitions of function values through zero), determination of the distance between peaks, wavelet analysis, or spectral analysis; see, e.g., M. Kunt, *Traitement Numérique des Signaux*, Presses Polytechniques Romandes.

Flame detectors detect flame radiation from potential fire sites. Such radiation, which is thermal or infrared radiation, may reach the detector directly or indirectly. A detector typically includes two pyroelectric sensors which are sensitive to two different wavelengths. One sensor may be sensitive in the $CO_2$ spectral range from 4.1 to 4.7 μm characteristic of infrared-emitting flame gases produced from carbon-containing materials. The other sensor may be sensitive in the wavelength range from 5 to 6 μm characteristic of interfering sources such as sunlight, artificial light or radiant heaters.

Greatly simplified, FIG. 3 shows a flame detector according to a preferred embodiment of the invention comprising an infrared-sensitive sensor 1, an amplifier 2, and a microprocessor or microcontroller 3 including an A/D converter. The sensor 1 includes an impedance converter and is provided with a filter 4 which is permeable only to radiation from the aforementioned $CO_2$ range of the spectrum, preferably to a wavelength of 4.3 μm. Radiation reaching the sensor 1 generates a corresponding voltage signal at the sensor output. This signal is amplified by the amplifier 2, and the amplified signal passes to the microprocessor 3 for analysis. The microprocessor 3 determines the square signal $X_i^2$, the mid-frequency $\omega_m$ and the cut-off frequency $\omega_g$, and carries out an analysis, e.g., by one of the methods described above.

For fuzzy-logic, the microprocessor or microcontroller 3 typically includes a fuzzy-controller having a rule base, e.g., with the aforementioned fuzzy-logic rules, and an inference engine. The flame detector may comprise more than one sensor (two, for example).

The described technique permits ready distinction of significant flame radiation from interfering radiation based on determinations of periodicity of flicker and of mid- and cut-off frequencies, and on comparison with the frequency values $G_1$ and $G_2$. Signal evaluation by fuzzy-logic has the additional advantage that relatively simple algorithms can be used, with modest computing and storage requirements.

I claim:

1. A method for detecting a flame having a magnitude which is not less than a predetermined minimum magnitude, the method comprising:

detecting radiation having time-varying intensity to produce a corresponding time-varying signal which has a frequency spectrum having a mid-frequency ($\omega_m$) and a cut-off frequency ($\omega_g$);

determining whether the time-varying signal is periodic; and producing a flame-detection signal (i) if the time-varying signal is periodic and its mid-frequency does not exceed a first frequency value ($G_1$) which is predetermined to be not less than flicker frequency of a stationary flame having minimum magnitude, or (ii) if the time-varying signal is not periodic and its cut-off frequency does not exceed a second frequency value ($G_2$) which is predetermined to be greater than the first frequency value.

2. The method of claim 1, wherein the flicker frequency of a stationary flame having minimum magnitude is predetermined by calculation, and wherein the first frequency value is predetermined to be greater than the calculated flicker frequency.

3. The method of claim 1, wherein the second frequency value is not less than three times the flicker frequency of a stationary flame having minimum magnitude.

4. The method of claim 1, wherein the second frequency value is substantially equal to three times the first frequency value.

5. The method of claim 1, wherein the determination as to periodicity comprises:

forming a quotient whose numerator is the cut-off frequency minus the mid-frequency and whose denominator is the cut-off frequency, and assessing the magnitude of the quotient.

6. The method of claim 1, comprising a determination of at least one of the mid-frequency and the cut-off frequency based on at least one of fast Fourier transform, determination of zero crossings, and spectral analysis of the time-varying signal.

7. A flame detector comprising at least one flame-radiation sensor for detecting radiation having time-varying intensity to produce a corresponding time-varying sensor signal, and evaluation circuitry connected to the sensor for analyzing the sensor signal, the evaluation circuitry comprising:

a first analyzer for determining a spectral mid-frequency ($\omega_m$) and a spectral cut-off frequency ($\omega_g$) of the sensor signal;

a second analyzer for determining whether the sensor signal is periodic; and a third analyzer for producing a flame-detection signal (i) if the sensor signal is periodic and its mid-frequency does not exceed a first frequency value ($G_1$) which is predetermined to be not less than flicker frequency of a stationary flame having minimum magnitude, or (ii) if the sensor signal is not periodic and its cut-off frequency does not exceed a second frequency value ($G_2$) which is predetermined to be greater than the first frequency value.

8. The flame detector of claim 7, wherein at least one of the first, second and third analyzers is embodied as an instructed portion of a microprocessor including a fuzzy-controller.

9. The flame detector of claim 8, wherein the third analyzer is embodied as an instructed portion of the fuzzy-controller, and wherein the instructed portion is instructed by at least one fuzzy-rule substantially corresponding to a rule selected from the group consisting of "if sensor signal small, then normal state", "if sensor signal large and sensor signal not periodic and sensor-signal cut-off frequency small or medium, then flame", "if sensor signal large and sensor signal not periodic and sensor-signal cut-off frequency large, then broad-band interfering source", "if sensor signal large and sensor signal periodic and sensor-signal cut-off frequency small, then flame", and "if sensor signal large and sensor signal periodic and sensor-signal cut-off frequency medium or large, then periodic interfering source".

* * * * *